US008470748B2

(12) United States Patent
Shimura et al.

(10) Patent No.: US 8,470,748 B2
(45) Date of Patent: Jun. 25, 2013

(54) ELECTROCONDUCTIVE GREASE

(75) Inventors: Akihiko Shimura, Ibaraki (JP); Yoshihito Tani, Ibaraki (JP); Toshio Nitta, Ibaraki (JP)

(73) Assignee: NOK Klueber Co., Ltd., Tokyo (JP)

( * ) Notice: Subject to any disclaimer, the term of this patent is extended or adjusted under 35 U.S.C. 154(b) by 12 days.

(21) Appl. No.: 13/054,186

(22) PCT Filed: Jun. 26, 2009

(86) PCT No.: PCT/JP2009/061745
§ 371 (c)(1),
(2), (4) Date: Jan. 14, 2011

(87) PCT Pub. No.: WO2010/010789
PCT Pub. Date: Jan. 28, 2010

(65) Prior Publication Data

US 2011/0111993 A1 May 12, 2011

(30) Foreign Application Priority Data

Jul. 22, 2008 (JP) ..... 2008-188106

(51) Int. Cl.
*C10M 107/38* (2006.01)
*C10M 113/02* (2006.01)

(52) U.S. Cl.
USPC ..... 508/130; 508/182; 508/582

(58) Field of Classification Search
USPC ..... 508/130
See application file for complete search history.

(56) References Cited

U.S. PATENT DOCUMENTS 6,652,149 B2 * 11/2003 Hokao et al. ..... 384/462
2003/0158047 A1 * 8/2003 Denpo et al. ..... 508/582
2004/0081380 A1 4/2004 Katagiri et al.
2005/0221996 A1 * 10/2005 Nakatani et al. ..... 508/130
2008/0167208 A1 * 7/2008 Hashida et al. ..... 508/582

FOREIGN PATENT DOCUMENTS

| | | |
|---|---|---|
| JP | 2001-304276 | 10/2001 |
| JP | 2002-250353 | 9/2002 |
| JP | 2003-269469 | 9/2003 |
| JP | 2004-162909 | 6/2004 |
| JP | 2007-308578 | 11/2007 |
| JP | 2008-024783 | 2/2008 |
| WO | WO 2006/090641 A1 | 8/2006 |

OTHER PUBLICATIONS

International Preliminary Report on Patentability and Written Opinion from corresponding PCT application No. PCT/JP2009/061745 dated Mar. 8, 2011, 11 pgs.
International Search Report from corresponding PCT application No. PCT/JP2009/061745 dated Aug. 25, 2009, 4 pgs.

* cited by examiner

*Primary Examiner* — Ellen McAvoy
*Assistant Examiner* — Vishal Vasisth
(74) *Attorney, Agent, or Firm* — Brinks Hofer Gilson & Lione

(57) ABSTRACT

Disclosed is an electroconductive grease comprising a fluorine oil, an electroconductive material, and a thickening agent, the electroconductive grease containing 5 to 20 wt. % of carbon black having a DBP oil absorption amount of 250 ml/100 g or less as the electroconductive material, and 2 to 15 wt. % of fluorine-containing resin particles having an average primary particle size of 1.0 μm or less as the thickening agent. The electroconductive grease comprises carbon black having specific properties, and fluorine-containing resin particles, preferably PTFE particles, having an average primary particle size of 1.0 μm or less, and therefore exhibits excellent oil separation characteristics, namely, a remarkably lower degree of oil separation, which can also be reduced to 10 wt. % or less.

11 Claims, No Drawings

ELECTROCONDUCTIVE GREASE

RELATED APPLICATION

This application is a 35 U.S.C. §371 national phase filing of International Patent Application No. PCT/JP2009/061745, filed Jun. 6, 2009, to which priority is claimed under 35 U.S.C. §119 to Japanese Patent Application No. 2008-188106, filed Jul. 22, 2008.

TECHNICAL FIELD

The present invention relates to an electroconductive grease. More particularly, the present invention relates to an electroconductive grease comprising a fluorine oil, an electroconductive material, and a thickening agent.

BACKGROUND ART

The problem of separation of the base oil (oil separation) from the electroconductive grease under high temperature directly affects the life span of practical machine bearings. Therefore, improvement of this problem is desired. Expecting the thickening effect of electro conductive materials, there are two-components system electroconductive greases. For example, Patent Document 1 proposes one comprising a fluorine base oil and a carbon black thickening agent; however, in order to overcome the problem of oil separation, PTFE must be mixed into this grease.

Therefore, Patent Document 2 proposes an electroconductive grease comprising a base oil (e.g., fluorine oil), a PTFE thickening agent, and 0.2 to 10 mass % of carbon black. The correlation between the DBP oil absorption amount of the carbon black used and the maximum bearing resistance indicates that the DBP oil absorption amount is preferably 180 ml/100 g or more in the range of 110 to 300 ml/100 g. However, Patent Document 2 does not provide any description of the properties and proportion of the PTFE thickening agent used.

Further, Patent Document 3 proposes a grease composition comprising a base oil comprising a synthetic oil and a fluorine oil, and a thickening agent comprising carbon black and PTFE in an amount of 5 to 40 wt. % based on the total mass of the grease, wherein the proportion of the carbon black and the PTFE thickening agent is 20:80 to 60:40 (mass %), and the carbon black has a DBP oil absorption amount of 100 ml/100 g or more. However, Patent Document 3 nowhere refers to the properties of the PTFE thickening agent used.

PRIOR ART DOCUMENT

Patent Document

Patent Document 1: JP-A-2001-304276
Patent Document 2: JP-A-2002-250353
Patent Document 3: JP-A-2003-269469

OUTLINE OF THE INVENTION

Problem to be Solved by the Invention

Generally, grease has a gel-like structure in which the base oil is incorporated into gaps in a network structure formed by the entanglement of the molecules or crystals mutually of the thickening agent. Owing to this structure, the base oil and the thickening agent are not easily separated from each other when no pressure (stress) is applied. However, when the grease is left naturally as it is for a long time, the motility of the base oil itself causes the base oil to gradually leak from the network structure, and the base oil starts to separate (oil separation). Since oil separation occurs in a shorter time under higher temperature in which the motility of the base oil increases, the degree of oil separation is expressed as a function of temperature and time.

When oil separation occurs, the separated base oil leaks from a sliding part, and the lubrication life span of the grease is thereby shortened. In addition, oil contamination occurs in the vicinities of the sliding part, resulting in an undesirable condition. Grease that hardly results in such a condition is said to have excellent oil separation characteristics.

An object of the present invention is to provide an electroconductive grease comprising a fluorine oil, an electroconductive material, and a thickening agent, and exhibiting excellent oil separation characteristics, namely, a remarkably lower degree of oil separation.

Means for Solving the Problem

The object of the present invention can be attained by the aforementioned electroconductive grease that comprises 5 to 20 wt. % of carbon black having a DBP oil absorption amount of 250 ml/100 g or less as the electroconductive material, and 2 to 15 wt. % of fluorine-containing resin particles having an average primary particle size of 1.0 μm or less as the thickening agent.

Effect of the Invention

The electroconductive grease of the present invention comprises carbon black having specific properties, and fluorine-containing resin particles, preferably PTFE particles, having an average primary particle size of 1.0 μm or less, and therefore exhibits excellent oil separation characteristics, namely, a remarkably lower degree of oil separation, which can be reduced to 10 wt. % or less.

EMBODIMENTS FOR CARRYING OUT THE INVENTION

A fluorine oil represented by the general formula:

$$RfO(C_3F_6O)p(C_2F_4O)q(CF_2O)rRf$$

can be used as the base oil. In the formula, Rf is a $C_1$-$C_5$ perfluoro lower alkyl group, such as perfluoromethyl, perfluoroethyl etc.; the $C_3F_6O$, $C_2F_4O$, and $CF_2O$ groups are randomly bonded to each other; p+q+r is 2 to 200; and p, q, or r may be 0. Specific examples of such polyether-based fluorine oils represented by the above general formula are listed below.

$$RfO[CF(CF_3)CF_2O]mRf \quad (1)$$

wherein m is 2 to 200. This fluorine oil can be obtained by complete fluorination of a precursor produced by photooxidation polymerization of hexafluoropropene. Alternatively, the fluorine oil can be obtained by anionic polymerization of hexafluoropropene oxide in the presence of a cesium fluoride catalyst, and then fluorine gas treatment of the obtained acid fluoride compound having a terminal-$CF(CF_3)COF$ group.

$$RfO[CF(CF_3)CF_2O]m(CF_2O)nRf \quad (2)$$

wherein the $CF(CF_3)CF_2O$ and $CF_2O$ groups are randomly bonded to each other; m+n is 3 to 200; and m:n is (10:90) to (90:10). This fluorine oil can be obtained by complete fluorination of a precursor produced by photooxidation polymerization of hexafluoropropene.

$$RfO(CF_2CF_2O)m(CF_2O)nRf \quad (3)$$

wherein m+n is 3 to 200, and m:n is (10:90) to (90:10). This fluorine oil can be obtained by complete fluorination of a precursor produced by photooxidation polymerization of tetrafluoroethylene.

Fluorine oils other than those represented by the above general formulae can also be used. For example, a polyether-based fluorine oil of the following formula can be used.

$$F(CF_2CF_2CF_2O)nCF_2CF_3 \quad (4)$$

wherein n is 2 to 100. This fluorine oil can be obtained by anionic polymerization of 2,2,3,3-tetrafluorooxetane in the presence of a cesium fluoride catalyst, and then fluorine gas treatment of the obtained fluorine-containing polyether $(CH_2CF_2CF_2O)n$ under UV irradiation at 160 to 300° C. The fluorine oils listed above as specific examples can be used alone or in the form of a mixture thereof; however, the fluorine oil (1) or (2) is preferably used in terms of cost performance.

These fluorine oils may have any value of kinematic viscosity; however, for the use as a lubricant, the kinematic viscosity is 5 to 2,000 $mm^2/s$ (40° C.), and preferably 100 to 1,500 $mm^2/s$ (40° C.) in consideration of use under high temperature conditions. That is, fluorine oils having a kinematic viscosity of less than about 5 $mm^2/s$ are largely evaporated, and do not comply with the requirements for the standard of JIS ball-and-roller bearing grease species 3, which is the standard for heat-resistant grease (i.e., the amount of evaporation is 1.5% or less). In contrast, fluorine oils having a kinematic viscosity of more than 2,000 $mm^2/s$ have a pour point (JIS K-2283) of 10° C. or more; bearings cannot be rotated by an ordinary method at the time of low-temperature starting; and they must be heated to make them usable. Therefore, the fluorine oils cannot suitably be used in general greases.

Carbon black that can be used as the electroconductive material has a DBP oil absorption amount (according to ASTM D1765-91) of 250 ml/100 g or less, preferably 150 ml/100 g or less, and more preferably 140 ml/100 g or less. When carbon black whose DBP oil absorption mount is beyond this range is used, even a small amount of addition results in coagulation, consequently producing a hard grease, which does not have good oil separation characteristics.

The carbon black having the above properties is used in an amount of 5 to 20 wt. %, preferably 5 to 15 wt. %, and more preferably 10 to 15 wt. %, in the electroconductive grease. The use of carbon black in this proportion ensures good conductivity and oil separation characteristics, and also enables the resulting grease to have a suitable consistency. When the amount of carbon black is less than this range, sufficient oil separation characteristics cannot be obtained; while when the amount of carbon black is more than this range, the obtained grease composition is hard and fails to exhibit properties suitable for the purpose.

Examples of the fluorine-containing resin particles used as the thickening agent include polytetrafluoroethylene [PTFE] particles, tetrafluoroethylene-perfluoro(alkyl vinyl ether) copolymer [PFA] particles, ethylene-tetrafluoroethylene polymer [ETFE] particles, hexafluoropropylene-tetrafluoroethylene copolymer [FEP] particles, polyvinylidene fluoride [PVDF] particles, and other fluorine-containing resin particles, preferably, PTFE particles, having an average primary particle size of 1.0 μm or less, and preferably 0.1 to 0.5 μm, are used. The average primary particle size as used herein is determined as the average of particle sizes of 100 or more particles on a photograph observed by a scanning electron microscope. Secondary aggregation particles formed by mutual coagulation of the particles are not included.

PTFE particles are preferably synthesized by emulsion polymerization of tetrafluoroethylene, and those having a number average molecular weight (Mn) of about 1,000 to 1,000,000 and having an average primary particle size of about 500 μm or less are obtained. Among these particles, those having a number average molecular weight (Mn) of about 1,000 to 500,000 and having an average primary particle size of μm or less, and preferable 0.1 to 0.5 μm, are screened by method such as a thermal decomposition method, an electron beam irradiation method, a γ-ray irradiation method, a physical pulverization method, or other method. The obtained PFTE particles have a melting point of about 250 to 400° C., and preferably about 300 to 350° C.

When PTFE particles having an average primary particle size of more than 1.0 μm are used, oil separation characteristics are deteriorated under high temperature, and adequate improvement in scattering resistance and leakage resistance, long service life, stable conductive properties, etc., cannot be expected. The fluorine-containing resin particles, such as PTFE particles described above, are used in an amount of 2 to 15 wt. %, preferably 2 to 9 wt. %, and more preferably 3 to 7 wt. %, in the grease composition. When the amount of fluorine-containing resin particles is less than this range, sufficient oil separation inhibiting effect cannot be obtained, and adequate improvement in scattering resistance and leakage resistance cannot be expected; while when the amount of fluorine-containing resin particles is more than this range, oil separation characteristics are not improved, but rather tend to be deteriorated.

In addition to fluorine-containing resin particles, other thickening agents, such as urea resins, silica, bentonite, and other minerals, organic pigments, polyethylene, polypropylene, polyamide, etc., can also be used in combination with a fluorine-containing resin particle thickening agent. In terms of heat resistance and lubricity, urea resins, such as diurea, triurea, and tetraurea, or silica are preferred.

The electroconductive grease of the above basic composition may contain, if necessary, antioxidants, rust inhibitors, corrosion inhibitors, extreme pressure additives, oiliness agents, solid lubricants, and other known additives used in conventional lubricants, depending on the purpose.

Examples of antioxidants include phenol-based antioxidants, such as 2,6-di-t-butyl-4-methylphenol and 4,4'-methylenebis(2,6-di-tertbutylphenol); amine-based antioxidants, such as alkyldiphenylamine (in which the alkyl group has 4 to 20 carbon atoms), triphenylamine, phenyl-α-naphthylamine, alkylated phenyl-α-naphthylamine, phenothiazin, and alkylated phenothiazin; and the like. These can be used singly or in combination of two or more.

Examples of rust inhibitors include fatty acids, fatty acid soaps, alkyl sulfonates, aliphatic amines, paraffin oxides, polyoxyethylene alkyl ethers, and the like.

Examples of corrosion inhibitors include benzotriazole, benzoimidazole, thiadiazole, and the like.

Examples of extreme pressure additives include phosphorus-based compounds, such as phosphoric esters, phosphite esters, and phosphoric ester amine salts; sulfur-based compounds, such as sulfides and disulfides; chlorine-based compounds, such as chlorinated paraffin and chlorinated diphenyl; and organometallic compounds, such as zinc dialkyl phosphorodithioate and molybdenum dialkyldithiocarbamate; and the like.

Examples of oiliness agents include fatty acids, higher alcohols, polyhydric alcohols, polyhydric alcohol esters, fatty acid esters, aliphatic amines, fatty acid monoglycerides, and the like.

Examples of solid lubricants include molybdenum disulfide, boron nitride, silane nitride, and the like.

The lubricous grease composition of the above components is prepared by mixing a fluorine oil with specified amounts of an electro conductive material, a thickening agent, and necessary additives, and then sufficiently kneading the mixture using a three-roll or a high-pressure homogenizer.

The following describes the present invention with reference to examples.

EXAMPLE

Preparation of Electroconductive Grease

Using four kinds of fluorine base oils A to D, three kinds of carbon blacks A to C, and four kinds of thickening agents A to D, greases of the formations (unit: wt. %) shown in the table below were prepared in Examples 1 to 11 and Comparative Example 1 to 5.

<<Base Oil>>

| | |
|---|---|
| A) $RfO[CF(CF_3)CF_2O]mRf$ | Kinematic viscosity (40° C.): 400 $mm^2/s$ |
| B) $RfO[CF(CF_3)CF_2O]mRf$ | Kinematic viscosity (40° C.): 230 $mm^2/s$ |
| C) $RfO[CF(CF_3)CF_2O]mRf$ | Kinematic viscosity (40° C.): 100 $mm^2/s$ |
| D) $RfO[CF(CF_3)CF_2O]m(CF_2O)nRf$ | Kinematic viscosity (40° C.): 390 $mm^2/s$ |

<<Carbon Black>>

A) DBP oil absorption amount: 68 ml/100 g

B) DBP oil absorption amount: 140 ml/100 g

C) DBP oil absorption amount: 360 ml/100 g

<<Thickening Agent>>

A) Polytetrafluoroethylene (Emulsion-polymerization method, melting point: 323 to 333° C., average primary particle size: 0.12 μm)

B) Polytetrafluoroethylene (Emulsion-polymerization method, melting point: 328 to 338° C., average primary particle size: 0.3 μm)

C) Polytetrafluoroethylene (Suspension-polymerization method, melting point: 320 to 330° C., average primary particle size: about 9 μm)

D) Polytetrafluoroethylene (Suspension-polymerization method, melting point: 313 to 323° C., average primary particle size: about 5 μm)

Various Tests for Electroconductive Grease

The obtained greases were subjected to the following tests.

1) Consistency Test

Each of the electroconductive greases of Examples 1 to 11 and Comparative Examples 1 to 5 was measured for consistency under the following conditions.

According to JIS K2220.5.7 corresponding to ASTM D217

25° C., 60 W

2) Confirmation Test of Oil Separation Degree

Each of the electroconductive greases of Examples 1 to 11 and Comparative Examples 1 to 5 was measured for degree of oil separation (unit: wt. %) under the following conditions.

<<Measurement Condition>>

According to JIS K2220.5.7 corresponding to ASTM D6184

Temperature: 250° C.

Time: 24 hours

3) Measurement Test of Volume Resistivity

Each of the electroconductive greases of Examples 1 to 11 and Comparative Examples 1 to 5 was held between two 10 cm-diameter, disk-shaped electrodes (gap: 1 mm), and the volume resistivity was determined from the resistance value after 30 minutes, specimen thickness, and electrode area using the following formula:

$$\rho v = Rv \times (s/t)$$

ρv: volume resistivity (unit: Ω·cm)

Rv: resistance value after 30 minutes (unit: Ω)

s: electrode area (unit: $cm^2$)

t: specimen thickness (unit: cm)

TABLE

| | Base oil | | CB | | PTFE | | Measurement item | | |
|---|---|---|---|---|---|---|---|---|---|
| Example | Type | wt. % | Type | wt. % | Type | wt. % | Consistency | Oil separation degree | Volume resistivity |
| Ex. 1 | A | 82.8 | A | 13.0 | B | 3 | 250 | 11.7 | $8.9 \times 10^3$ |
| Ex. 2 | A | 80.8 | A | 13.0 | B | 5 | 254 | 7.4 | $8.9 \times 10^3$ |
| Ex. 3 | A | 78.8 | A | 13.0 | B | 7 | 240 | 12.0 | $8.6 \times 10^3$ |
| Ex. 4 | A | 75.8 | A | 13.0 | B | 10 | 236 | 13.7 | $8.0 \times 10^3$ |
| Ex. 5 | A | 80.5 | A | 13.0 | A | 5 | 238 | 5.3 | $1.6 \times 10^4$ |
| Ex. 6 | A | 83.5 | B | 10.0 | B | 5 | 245 | 12.0 | $9.0 \times 10^3$ |
| Ex. 7 | B | 80.5 | A | 13.0 | B | 5 | 265 | 8.4 | $9.0 \times 10^3$ |
| Ex. 8 | C | 80.5 | A | 13.0 | B | 5 | 273 | 9.5 | $9.0 \times 10^3$ |
| Ex. 9 | D | 80.5 | A | 13.0 | B | 5 | 259 | 7.9 | $9.0 \times 10^3$ |
| Ex. 10 | A | 81.5 | A | 12.0 | B | 5 | 260 | 7.9 | $1.0 \times 10^4$ |
| Ex. 11 | A | 82.5 | A | 11.0 | B | 5 | 267 | 9.5 | $2.5 \times 10^4$ |
| Comp Ex. 1 | A | 85.8 | A | 13.0 | — | — | 299 | 19.4 | $2.9 \times 10^4$ |
| Comp Ex. 2 | A | 84.8 | A | 13.0 | B | 1 | 277 | 17.9 | $9.8 \times 10^3$ |
| Comp Ex. 3 | A | 80.5 | A | 13.0 | C | 5 | 260 | 14.1 | $5.4 \times 10^3$ |
| Comp Ex. 4 | A | 80.5 | A | 13.0 | D | 5 | 241 | 15.1 | $4.7 \times 10^3$ |
| Comp Ex. 5 | A | 91.0 | C | 2.5 | B | 5 | 250 | 15.0 | $9.0 \times 10^3$ |

INDUSTRIAL APPLICABILITY

The electroconductive grease of the present invention has low oil separation characteristics, and can be used in ball-and-roller bearings, plain bearings, or the like as a grease which is required to have electrostatic discharge performance and high temperature durability are required. Particularly, the electroconductive grease can suitably be used in bearings of photosensitive drums, fixing rolls, or the like of electrostatic transfer copying machines. Further, the electroconductive grease can also be used in bushes or contacting parts of electrostatic transfer copying machines.

In addition, the electroconductive grease can be used for lubrication purpose in which heat resistance, lubricity, durable lives, etc., are required, although conductivity is not required so much. The following applications can be given as examples.

Automobiles: ball-and-roller bearings, plain bearings, or gear parts of electric radiator fan motors, fan couplings, electronically controlled EGR, electronically controlled throttle valves, alternators, idler pulleys, electric brakes, hub units, water pumps, power windows, wipers, electric power steering systems, etc., in which heat resistance, load resistance, and shear stability are required;

electric contact parts of control switches for automatic transmissions, lever control switches, push switches, etc., in which heat resistance, shear stability, and abrasion resistance are required; and rubber sealing parts of X ring parts of viscous couplings, O rings of exhaust brakes, etc., in which heat resistance and shear stability are required.

Resin manufacturing apparatuses: ball-and-roller bearings, plain bearings, pins, oil seals, gears, etc. of film tenters, film laminators, Banbury mixers, etc., in which heat resistance and load resistance are required.

Paper making devices: ball-and-roller bearings, plain bearings, pins, oil seals, gears, etc., of corrugate machines etc., in which heat resistance and load resistance are required.

Timber processing devices: ball-and-roller bearings, plain bearings, pins, oil seals, gears, etc., of conch presses etc., in which heat resistance and load resistance are required.

Machines for food products: linear guides of bread-baking machines, ovens, etc., and ball-and-roller bearings etc. in which heat resistance and abrasion resistance are required.

Others: ball-and-roller bearings, gears, etc., in vacuum pumps of semiconductor manufacturing apparatuses, liquid crystal manufacturing apparatuses, electron microscopes, etc;

ball-and-roller bearings in breakers of electric power controllers;

ball-and-roller bearings, plain bearings, gears, sliding parts, etc., of headlights, sheets, ABSs, door locks, door hinges, clutch boosters, two-divided flywheels, window regulators, ball joints, clutch boosters, etc., of automobiles;

ball-and-roller bearings, plain bearings, oil seals, etc., in cooling fans for personal computers, vacuum cleaners, washing machines, etc.;

ball-and-roller bearings, plain bearings, etc., in spindles or servomotors of household electrical/information appliances and machine tools; and hinge sliding parts etc. of mobile phones and personal computers.

The invention claimed is:

1. An electroconductive grease consisting essentially of:

(A) 65 to 93 wt. % of a base oil consisting of a fluorine oil represented by the at least one of general formula:

$$RfO[CF(CF_3)CF_2O]_mRf \quad [I]$$

wherein Rf is a $C_1$-$C_5$ perfluoro lower alkyl group and m is 2 to 200, or $$RfO[CF(CF_3)CF_2O]_m(CF2O)_nRf \quad [II]$$

wherein Rf is a $C_1$-$C_5$ perfluoro lower alkyl group; the $CF(CF_3)CF_2O$ and $CF_2O$ groups are randomly bonded to each other; m+n is 3 to 300; and m:n is (10:90) to (90:10);

(B) 5 to 20 wt. % of an electroconductive material that consists of carbon black having a DBP oil absorption amount of 250 ml/100 g or less; and (C) 2 to 15 wt. % of a thickening agent that consists of fluorine-containing resin particles having an average primary particle size of 1.0 μm or less.

2. The electroconductive grease according to claim 1, wherein the carbon black as a DBP oil absorption amount of 150 ml/100 g or less.

3. The electroconductive grease according to claim 1, wherein the fluorine-containing resin particles are PTFE particles.

4. The electroconductive grease according to claim 3, wherein the PTFE particles have an average primary particle size of 0.1 to 0.5 μm.

5. The electroconductive grease according to claim 1, wherein the amount of the fluorine-containing resin particles is 2 to 9 wt. %.

6. The electroconductive grease according to claim 3, wherein the amount of the fluorine-containing resin particles is 2 to 9 wt. %.

7. The electroconductive grease according to claim 1, wherein the amount of the fluorine-containing resin particles is 3 to 7 wt. %.

8. The electroconductive grease according to claim 3, wherein the amount of the fluorine-containing resin particles is 3 to 7 wt. %.

9. The electroconductive grease according to claim 1, which is used in a ball-and-roller bearing or a plain bearing.

10. The electroconductive grease according to claim 9, which is used in bearing at least one of a photosensitive drum and a fixing roll of an electrostatic transfer copying machine.

11. The electroconductive grease according to claim 1, wherein is used in a bush and/or contacting part of an electrostatic transfer copying machine.

* * * * *